US007628211B1

(12) United States Patent
Wintill et al.

(10) Patent No.: US 7,628,211 B1
(45) **Date of Patent: *Dec. 8, 2009**

(54) METHOD OF CONNECTING CONTROL LINES TO WELL BORE EQUIPMENT FOR CONTROLLING A WELL ON A BATCH BASIS

(75) Inventors: Charles David Wintill, Houston, TX (US); Rodney Wayne Long, Cypress, TX (US); William Ryle Darnell, St. Martinville, LA (US); William John Darnell, Houston, TX (US); Michael Chad Darby, Katy, TX (US)

(73) Assignee: PetroQuip Energy Services, LLP, Houston, TX (US)

( * ) Notice: Subject to any disclaimer, the term of this patent is extended or adjusted under 35 U.S.C. 154(b) by 257 days.

This patent is subject to a terminal disclaimer.

(21) Appl. No.: 11/766,088

(22) Filed: Jun. 20, 2007

(51) Int. Cl.
*E21B 17/00* (2006.01)
*E21B 23/00* (2006.01)

(52) U.S. Cl. ..... 166/380; 166/242.6; 166/381; 166/385

(58) Field of Classification Search ..... 166/242.6, 166/380, 381, 385
See application file for complete search history.

(56) References Cited

U.S. PATENT DOCUMENTS 6,983,796 B2 1/2006 Bayne et al.
7,428,932 B1 * 9/2008 Wintill et al. ..... 166/381

* cited by examiner

*Primary Examiner*—Jennifer H Gay
*Assistant Examiner*—Yong-Suk Ro
(74) *Attorney, Agent, or Firm*—Buskop Law Group, PC; Wendy Buskop

(57) ABSTRACT

A method for connecting control lines to well bore equipment for controlling a well on a batch basis. A batch basis as used herein can mean that the well is controlled periodically. A first half of the pin connector can be formed by securing an extending hydraulic wet connector to a lower tubular portion. The lower tubular portion can have a lower tubular body, a first pin, and a lower hydraulic flow path.

28 Claims, 8 Drawing Sheets

METHOD OF CONNECTING CONTROL LINES TO WELL BORE EQUIPMENT FOR CONTROLLING A WELL ON A BATCH BASIS

FIELD

The present embodiments relate generally to pin connector with a seal assembly that can be used in downhole well.

BACKGROUND

A need exists for a method for creating an intelligent completion system for use inside a multi-zone hydrocarbon well.

There further exists a need for a method for connecting control lines wellbore equipment using a pin connector with seal assembly that can be pulled after use, taken apart, cleaned, and reused.

The present embodiments meet these needs.

BRIEF DESCRIPTION OF THE DRAWINGS

The detailed description will be better understood in conjunction with the accompanying drawings as follows.

Figure 1:
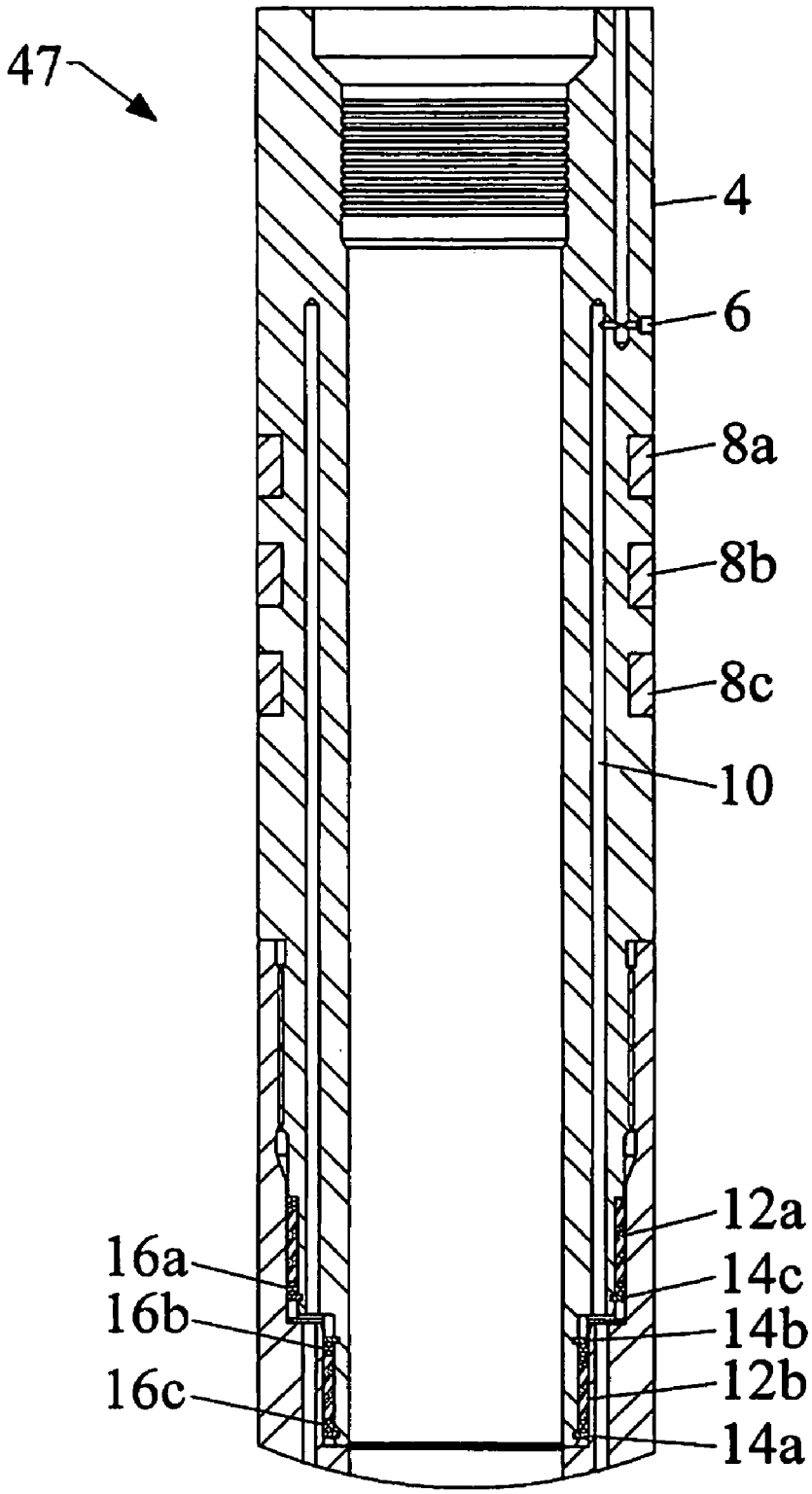
FIG. 1 depicts a cross sectional view of an embodiment of a seal assembly usable with a second half of a pin connector with seal assembly that is adapted for use with an embodiment of the method.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The embodiments of the invention generally relate to a method of connecting control lines to well bore equipment for controlling a well on a batch basis. A batch basis as used herein can mean that the well is controlled periodically.

An embodiment of the method can include forming a first half of a pin connector. The first half of the pin connector can be formed by securing an extending hydraulic wet connector to a lower tubular portion. The lower tubular portion can have a lower tubular body, a first pin, and a lower hydraulic flow path.

The first half of the pin connector can be attached to at least one hydraulically operated tool. The first half of the pin connector can also be attached to a packer with a bore. After connection the first half of the pin connector attached to the packer is ran into the well.

The present embodiment of the method further includes forming a second half of a pin connector. The second half of the pin connector can be formed by securing a receiving hydraulic wet connector to an upper tubular portion with seal assembly. The upper tubular portion comprises an upper tubular body and an intermediate hydraulic flow path.

The seal assembly can include a tubular seal assembly body, an upper hydraulic flow path engaging the intermediate hydraulic flow path, a plurality of upper concentric seals for sealing the second half of the pin connector into the bore of the packer, and at least one fastener.

The formed second half of the pin connector can be connected to a production tubing and a control line. A second end of the control line should be connected to a hydraulic source. The production tubing with the connected second half of the pin connector and the connected control line can be ran into the well.

The method further includes connecting the receiving hydraulic wet connector to the extending hydraulic wet connector. After the connection of the wet connectors the second half of the pin connector can be anchored to another piece of well equipment.

The control line can be used to operate the well on a periodic basis. Controlling the well on a periodic basis reduces impact. The periodic operation also prevents cycle loading fatigue. The reduction in cycle loading fatigue is experienced because fatigue is a function of load cycles.

It is contemplated that in an embodiment of the method can be adapted for multi-zone wells. The method would further include forming a first half of another pin connecter by securing another pin connector extending hydraulic wet connector to a lower tubular portion. The lower tubular portion can include a lower tubular body, a second pin, and a lower hydraulic flow path.

The first half of the other pin connector can be attached to at least one second hydraulically operated tool. The hydraulic operated tools can be a hydraulic sleeve, an injection mandrel, hydraulic valve, or combinations thereof.

In a second embodiment the first half of the other pin connector can be attached to the second half of the pin connector. It is contemplated that the first half of the other pin connector can be attached to the second half of the pin connector and at least one hydraulically operated tool.

A second packer with a bore can be attached to the second half of the other pin connector.

The first half of the other pin connector and the attached second packer can be run into the well.

A second half of the other pin connector is formed by securing a bottom pin connector receiving hydraulic wet connector to the other pin connector upper tubular portion with seal assembly.

The other pin connector upper tubular portion includes an upper tubular body and an intermediate hydraulic flow path.

The formed second half of the other pin connector is connected to a second control line. The second control line is for connecting the second half of the other pin connector to a hydraulic source.

The second control line terminates at the second half of the other pin connector. The second control line and the first control line are in fluid communication.

A second production tubing is connected to the second half of the other pin connector. After connecting the production tubing with the connected second half of the other pin connector and the connected second control line can be ran into the well.

The receiving hydraulic wet connector of the other pin connector can be connected to the extending hydraulic wet connector of the other pin connector.

The second half of the other pin connector is anchored to a piece of well equipment. The piece of well equipment could be a first half of a pin connector, another pice of well equipment, or combinations thereof.

The anchoring the second half of the pin connector to another piece of well equipment is performed using a locking mechanism. The locking mechanism can include a locking key; a lower key retainer; a shear pin for engaging the locking key and the lower key retainer; an upper key retainer for engaging the locking key and the upper tubular portion; at least one fastener; and a mechanism for exerting a force on the locking key and the upper tubular portion.

The receiving hydraulic wet connector of each pin connector, and the receiving hydraulic wet connector of each pin connector can be aligned. The alignment can be performed by using at least one alignment key with an alignment groove.

The other piece of well equipment connected to the second half of the first and second pin connectors can include the first half of a pin connector, or another piece of well equipment.

It is possible to repeat the above steps depending on the number of zones within the well.

An embodiment of the method can include sealing each upper hydraulic flow path and intermediate hydraulic flow path using a plurality of upper hydraulic flow path seals between each tubular seal assembly body and each upper tubular body.

An embodiment of the method can include providing a means for retaining the upper hydraulic flow seals using a plurality of seal assembly fasteners.

In a contemplated embodiment of the method each receiving hydraulic wet connector for each pin connector with seal assembly can be a quick release receiving hydraulic wet connector.

In an embodiment of the invention the first upper tubular portion, the second upper tubular portion, and any additional upper tubular portion can include an upper portion of a locking mechanism, which is connected to the upper tubular body. The upper portion engages a locking mechanism on the lower tubular body.

The seal assembly includes a tubular seal assembly body, an upper hydraulic flow path engaging the intermediate hydraulic flow path, a plurality of upper concentric seals for sealing the second half of the pin connector into the bore of the packer, and at least one fastener. The first control line can communicate with the first half of the second pin connector.

The embodiments of the invention can be best understood with reference to the figures.

Referring now to FIG. 1, which depicts an embodiment of a seal assembly 47. The seal assembly 47 includes a tubular seal assembly body 4, a hydraulic flow path plug 6, a upper hydraulic flow path 10 formed in the tubular seal assembly body 4, a first seal ring 16*a*, a second seal ring 16*b*, and a third seal ring 16*c*, a first upper hydraulic flow path seal 12*a*, a second hydraulic flow path seal 12*b*, a first seal assembly fastener 14*a*, a second seal assembly fastener 14*b*, a third seal assembly fastener 14*c*, a first upper concentric seal 8*a*, a second upper concentric seal 8*b*, and a third upper concentric seal 8*c*.

The tubular seal assembly body 4 can be made from alloy steel, and can have a length ranging from 10 inches to 36 inches, a diameter ranging from 2.688 inches to 6 inches. The seal assembly body 4 is depicted having the hydraulic flow path plug 6, such as lee plug from Lee Company in Connecticut. The hydraulic flow path plug 6 provides a seal for the upper hydraulic flow path 10.

The hydraulic flow path can have a volumetric flow rate equivalent to the capacity of a 0.25 inch control line. The hydraulic flow path can be formed into the tubular seal assembly by inserting a hydraulic line with a diameter ranging from 0.25 inches to 0.5 inches.

The first seal ring 16*a* can support a first hydraulic flow path seal 12*a* and be made from an alloy steel or non elastomeric material, such as a rigid polyethylene seal ring or rigid polyethylene/polypropylene copolymers.

The second seal ring 16*b* can support the second hydraulic flow path seal 12*b*. The first seal ring 16*a* and the second seal ring 16*b* provide support the hydraulic flow path seals.

The first and second hydraulic flow path seals 12*a* and 12*b* can have a diameter ranging from 1.9 inches to 6.75 inches. The flow path seals can be made from non elastomeric materials, such as polymer plastics, including polyethyl ketone (PEEK™), or other materials.

The first seal ring 16*a*, the second seal ring 16*b*, and the third seal ring 16*c* can be similar in design or in the alternative each seal ring can be made from a different material. The diameters of each seal ring can be similar or different.

The first seal assembly fastener 14*a* can be a threaded cap. The second seal assembly fastener 14*b*, which can be similar to the first seal assembly fastener 14*a*. The fasteners are adapted to retain the second upper hydraulic flow path seal 12*b*.

The third seal assembly fastener 14*c*, which can be similar to the second seal assembly fastener 14*ab*, which can be similar to the first seal assembly 14*a*.

It is possible to have an embodiment wherein the first seal assembly fastener, the second seal ring fastener, the third seal ring fastener made from steel.

The first, second and third concentric seals 8*a*, 8*b*, and 8*c* can be an elastomeric or non-elastomeric seal. Greene Tweed from Houston Tex. supplies usable concentric seals for this embodiment. The first concentric seal 8*a*, the second concentric seal 8*b*, and the third concentric seal 8*c* can be similar to each other.

Figure 2:
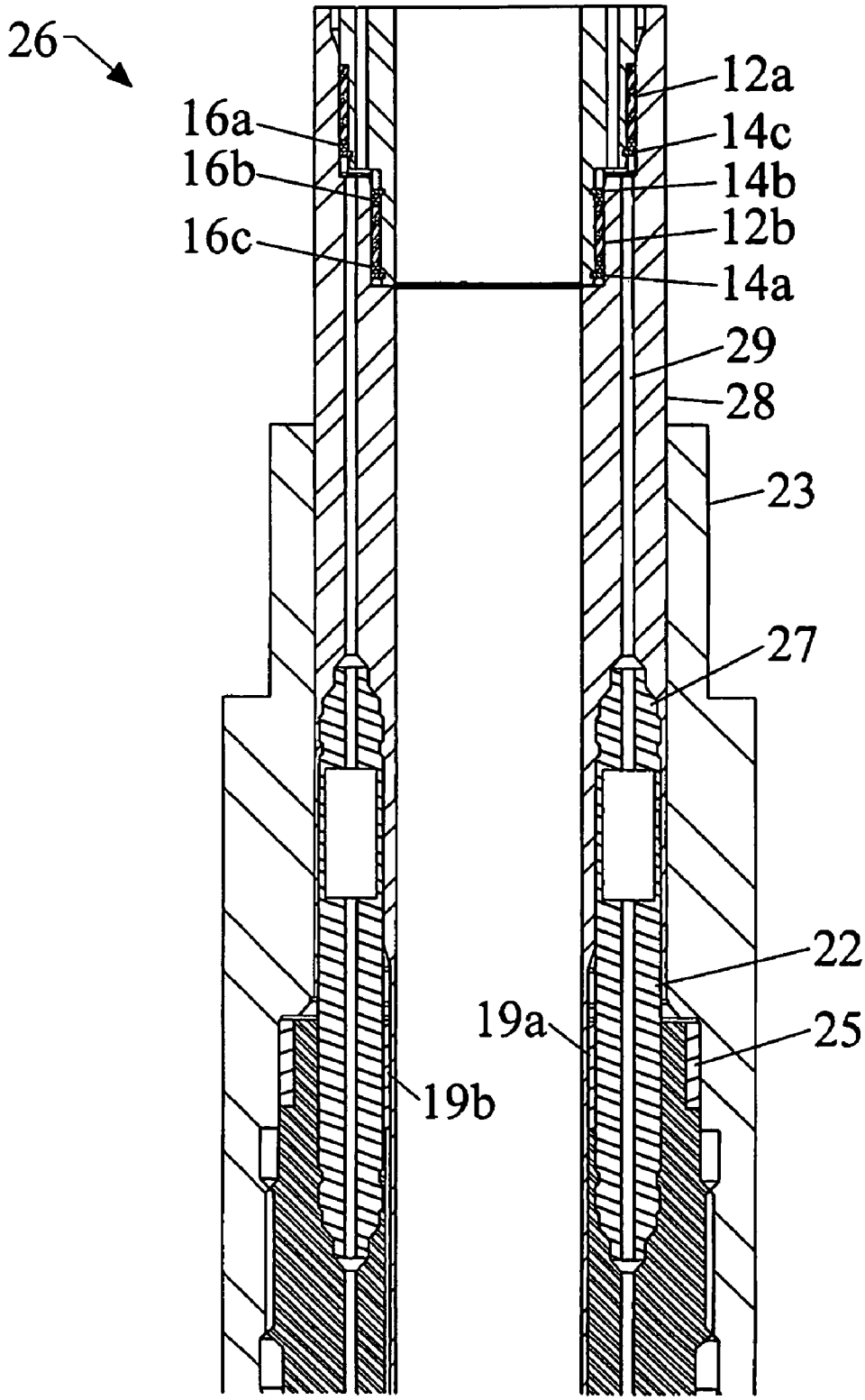
FIG. 2 depicts a cross sectional view of an embodiment of a second half of the pin connector with seal assembly that is adapted for use with an embodiment of the method.

Turning now to FIG. 2 the upper tubular portion 26 is depicted. The upper tubular portion 26 has an upper tubular body 28 that removably engages the seal assembly 47. The seal assembly 47 is best depicted in FIG. 1. The upper tubular body 28 can be made from alloy steel, and have a length ranging from 2 feet to 6 feet.

Returning to FIG. 2, the upper tubular portion 26 is depicted having an intermediate hydraulic flow path 29. The intermediate hydraulic flow path can have an inner diameter from 0.125 inches to 0.5 inches. In the alternative embodiment, the intermediate hydraulic flow path can be a machined port. The intermediate hydraulic flow path 29 is in fluid communication with the upper hydraulic flow path 10. The upper hydraulic flow path 10 is depicted in FIG. 1.

The intermediate hydraulic flow path 29 and the upper hydraulic flow path 10 are coupled together, for example using the seals.

Figure 3:
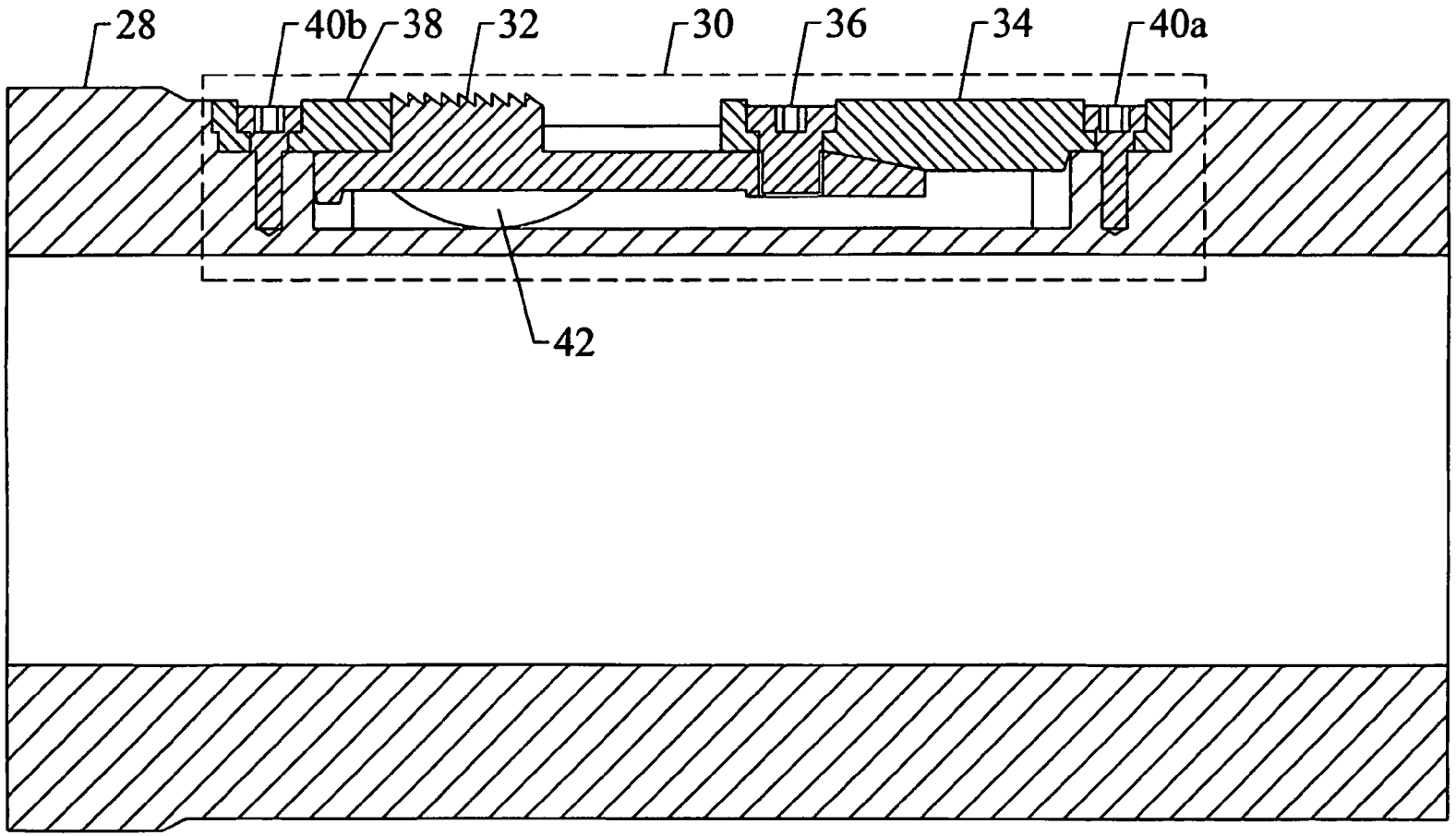
FIG. 3 depicts a detailed cross sectional view of a locking mechanism for use with the pin connector with seal assembly adapted for use with an embodiment of the method.

Referring now to FIG. 3, the upper tubular portion 28 is connected to an upper portion 30 of a locking mechanism 24.

The upper portion 30 is depicted having a shear pin 36, such as a brass or annealed steel shear pin, such as those available from Shamrock Fasteners of greater Houston, Tex.

A locking key 32 is machined as part of the overall pin and seal assembly in to the upper tubular of the lower tubular portion or both. The locking key is a combination of grooves and projections that interlock together.

A lower key retainer 34 is a machined part used for holding the locking key in either the locked or unlocked position. In an embodiment, the lower key retainer can be a circular part with a diameter larger than the annulus of the bore of the tool. The retainer can be a segment, such as a "D" shape or an open "D" shape.

An upper key retainer 38 can be similar to the lower key retainer. In an embodiment, the upper key retainer can be a circular part with a diameter larger than the annulus of the bore of the tool. The upper key retainer can be a segment, such as a "D" shape or an open "D" shape.

The mechanism for providing force 42 can be a coiled spring, a wave spring, or a similar force providing mechanism. If a coiled spring is used, it can be one provided by Suhm of Houston, Tex.

The shear pin 36 engages the locking key 32 and the lower key retainer 34. The shear pin 36 can be a solid cylinder with a centrally aligned through hole. The shear pin 36 can be made from steel, stainless steel, or similar materials.

The upper key retainer 38 can have a channel, with a depth ranging from 0.5 inches to 1 inches adapted for receiving the locking key 32.

The upper portion 30 is secured to upper tubular portion 26 by the first fastener 40*a* and the second fastener 40*b*. The first fastener 40*a* and the second fastener 40*b* can be planarly aligned with each other. It is possible to use more than two fasteners to secure the upper locking mechanism to the upper tubular portion 26.

The mechanism for exerting force 42 interacts with the locking key 32 and the upper tubular portion 28.

The interaction of the mechanism for exerting force 42 with the locking key 32 and the upper tubular portion 28 provides the benefit of providing retraction in and out, an axial force when the lower tubular portion is driven into the well, in a ratcheting unidirectional motion.

Returning to FIG. 2, a fastener 23 can be located on the upper tubular portion of the pin and seal assembly, for securing to a piece of well equipment, wherein the piece of well equipment can be a packer, or another type of well equipment.

The fastener 23 can be a collar for engaging the upper portion 30 and the collar is for anchoring the upper tubular portion to another piece of well equipment.

FIG. 2 further depicts a lower tubular seal 25 which is disposed between the collar 23 and the lower tubular portion 14. The lower tubular seal 25 can have a diameter ranging from 1.9 inches to 6 inches. The lower tubular seal 25 can be made from plastic, elastomeric material or a non-elastomeric material to create seals.

The upper tubular portion has a receiving hydraulic wet connector 27, for example, a Seaport wet connect made by Diamould from the United Kingdom. The receiving hydraulic wet connector 27 removeably engages an extending hydraulic wet connector 22, which can also be made by Diamould. The receiving hydraulic wet connector 22 is supported by the upper tubular body 28.

The upper tubular body 28 supports the receiving hydraulic wet connector 22 by creating a threaded engagement with the receiving hydraulic wet connector 22.

FIG. 2 depicts a first alignment key 19*a*, and a second alignment key 19*b*, which is similar to the first alignment key 19*a*. The alignment keys are machined parts that are at least partially disposed on the lower tubular body 15.

Although the embodiment in FIG. 2 depicts two alignment keys, it is possible to have more than two alignment keys or less than two alignment keys, as long as there is at least one alignment key. In an alternative embodiment, the alignment keys can differ from each other. In length and thickness. For example one alignment key can have a length of ¼ inch and the second alignment key can have a length of 10 inches.

Figure 4A:
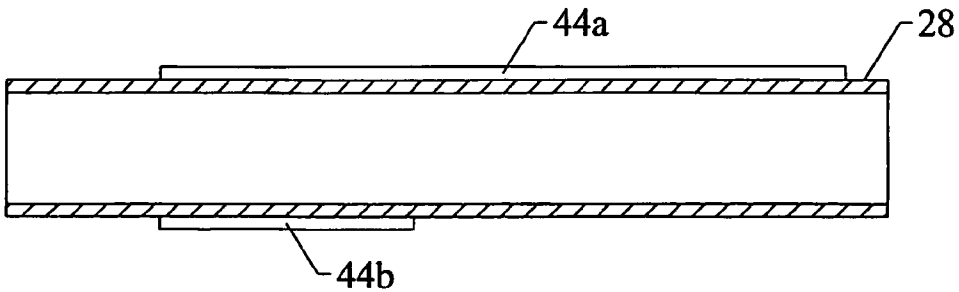
FIG. 4*a* depicts a cross sectional view of an embodiment of a upper tubular body with at least one alignment groove that is usable with the embodiments of the pin connector with seal assembly usable with an embodiment of the method.
Figure 4B:
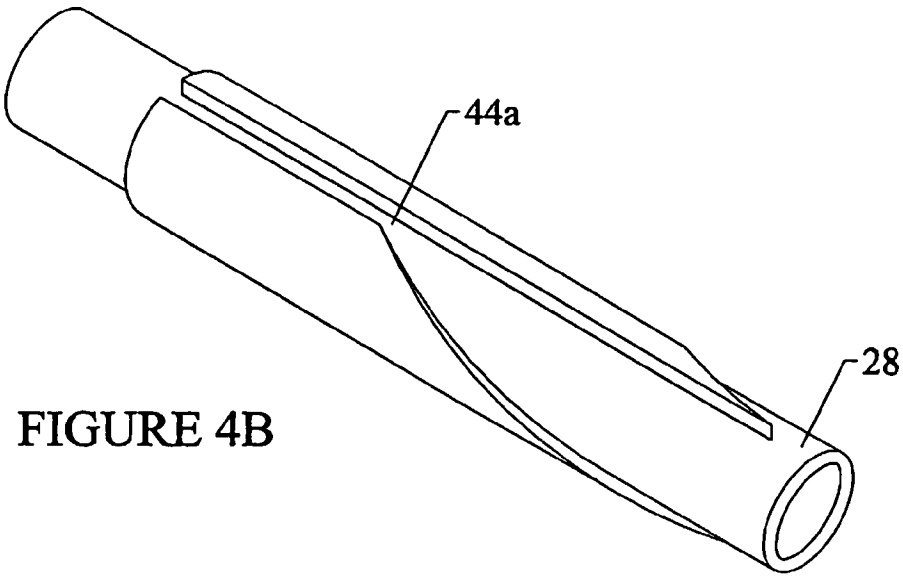
FIG. 4*b* is a perspective view of the upper tubular body with the alignment groove usable with an embodiment of the method.

Turning now to FIG. 4, which depicts a first alignment groove 44*a* and a second alignment groove 44*b* formed on the upper tubular body 28. The first alignment groove 44*a* receives either alignment key 19*a* and the second alignment groove 44*b* receives either alignment key. There should be at least one alignment groove.

The first alignment groove 44*a* and the second alignment groove 44*b* can have a depth ranging from 0.30 inches to 0.05 inches. The alignment grooves can be molded, machined, or forged into the upper tubular body 28.

Figure 5:
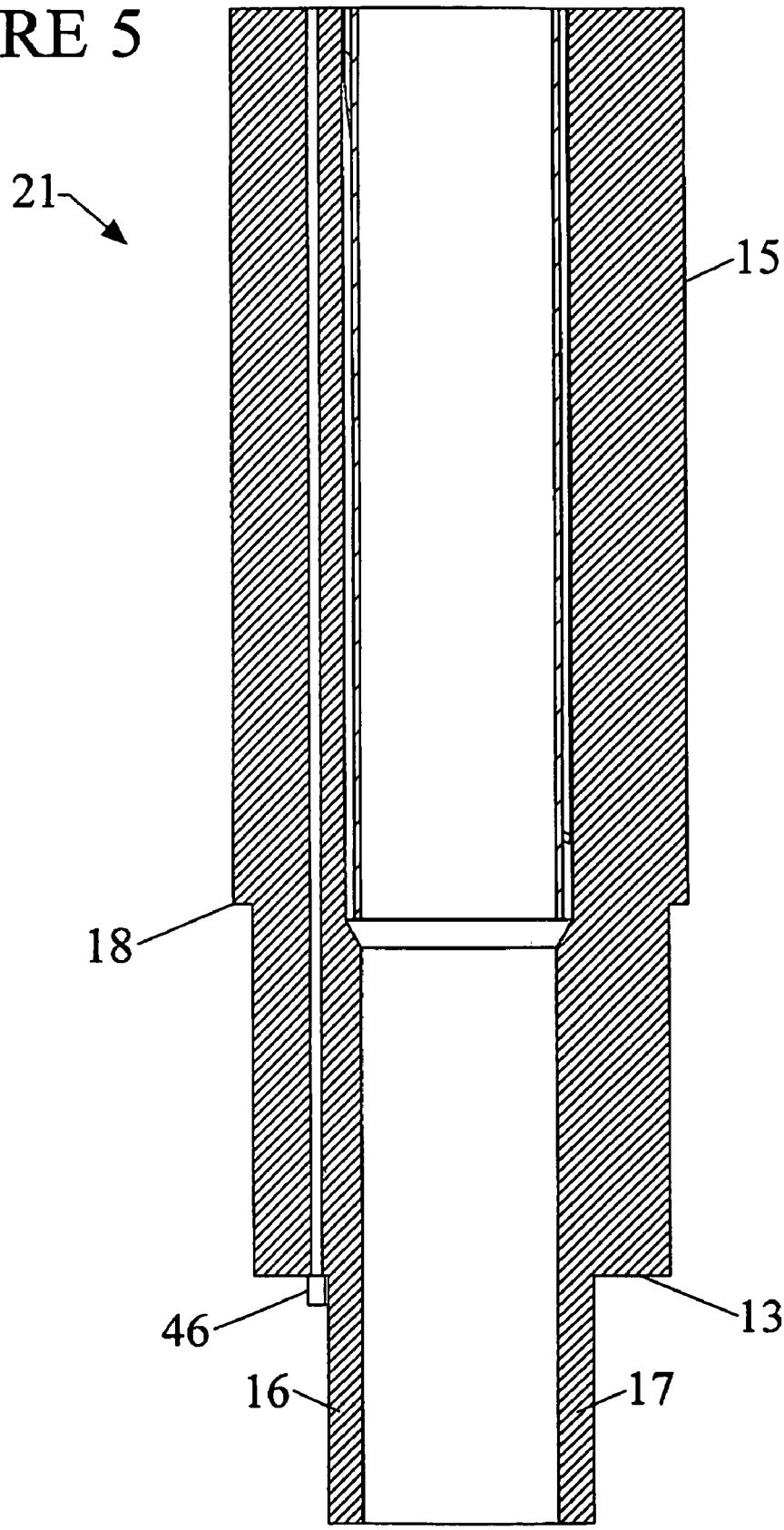
FIG. 5 depicts a cross sectional view of an embodiment of the first half of a pin connector adapted for use with an embodiment of the invention.

Turning now to FIG. 5, which depicts an embodiment of the lower tubular portion 14. The lower tubular portion 14 has a lower tubular body 15. The lower tubular body 15 can have a length ranging from 2 feet to 6 feet, and an outer diameter ranging from 2 inches to 15 inches.

A lower hydraulic flow path 20 is formed into the lower tubular body 15. The lower hydraulic flow path 20 fluidly engages the intermediate hydraulic flow path 29. The fluid engagement is enabled by a coupling.

The lower hydraulic flow path 20 can be a port machined into the lower tubular body 15.

In a typical embodiment of the invention each of the hydraulic flow paths have the same hydraulic fluid and the same flow rate.

The lower tubular body has a lower tubular body face 13. The lower tubular body face 13 can have a flange angle ranging from 30 degrees to 90 degrees. The lower tubular body face 13 can be made from a metal adapted to survive a highly corrosive environment.

The lower tubular portion further has a first pin 16. The pin 16 can be manufactured by Pertroquip Energy Services of Broussard La. and Houston Tex. The first pin 16 can have a length ranging from 3 inches to 9 inches. The first pin 16 can have a cylindrical shape and can be solid or hollow.

The first pin 16 has a first pin outer surface 17. The first pin outer surface can be a metal, composite, or similar material. The first pin outer surface 17 in a typical embodiment will be made form the same material of the first pin 16

In the embodiment depicted in FIG. 5, a second pin 18. The second pin 18 concentrically surrounds the first pin 16. In the embodiment in FIG. 5 a double pin connector is formed suing the first and second pins. The double pin connector can be adapted for multi zone gravel packing in a hydrocarbon well. It should be noted that the two pin embodiment is not required, and that it is possible for an embodiment of the invention to have only a first pin 16.

FIG. 5 depicts a control line connector 46 disposed between the first pin outer surface 17 and the lower tubular body face 13. The control line connector 46 can be adapted to handle a fluid pressure ranging from 2,000 psi to 20,000 psi.

Figure 6A:
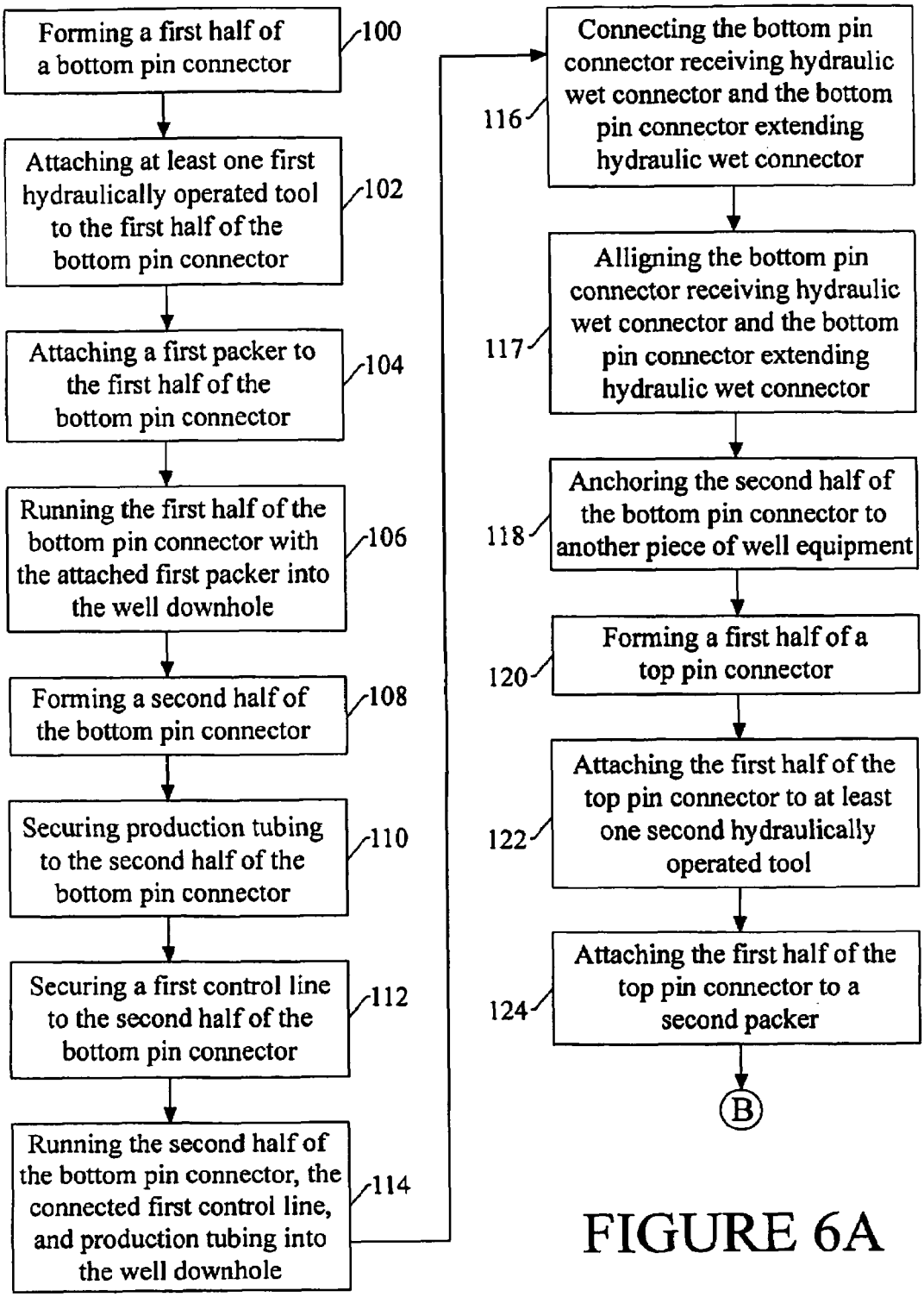
FIG. 6 depicts a flow diagram of an embodiment of the method.
Figure 6B:
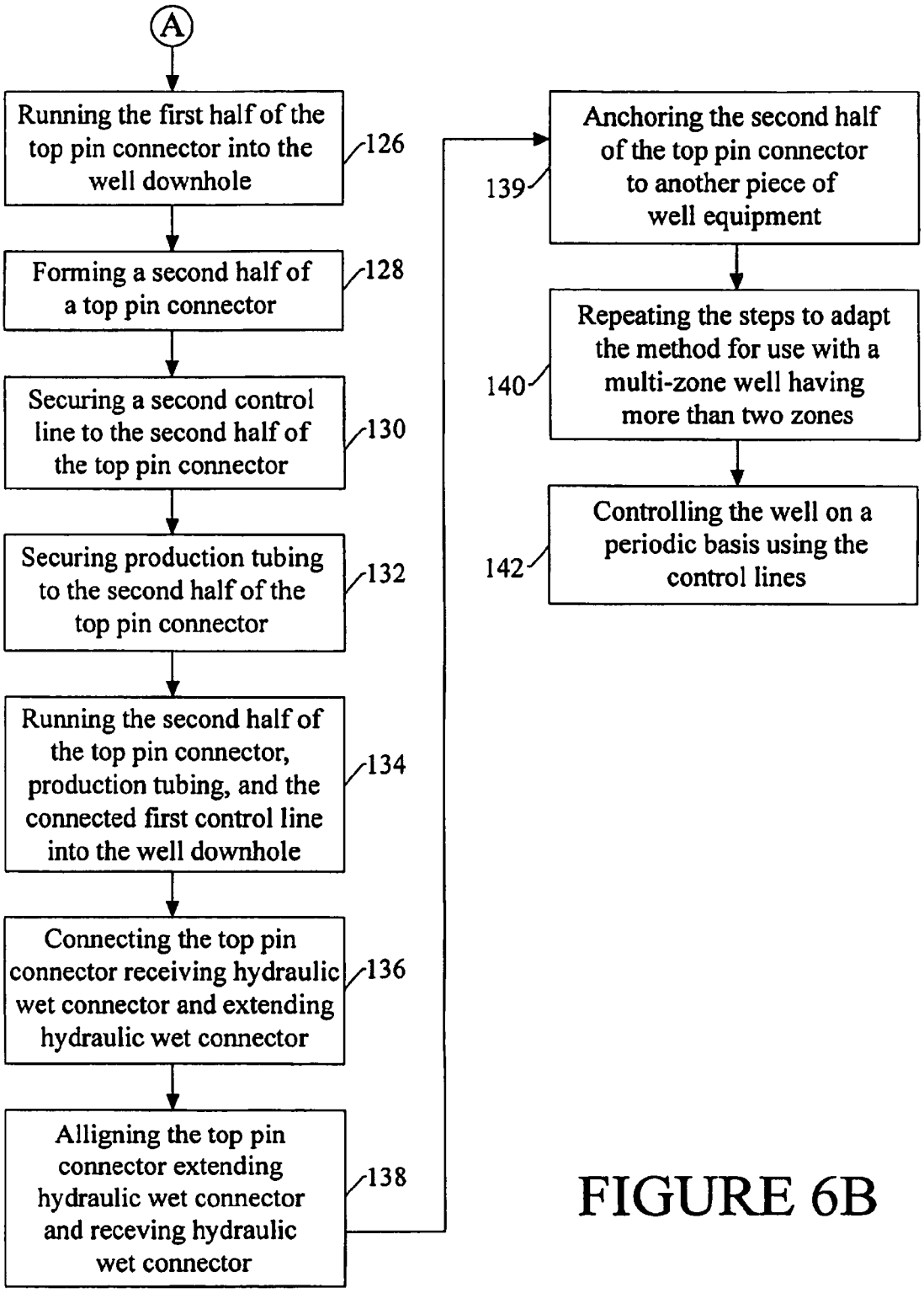

FIG. 6 depicts an embodiment of the method. The step of forming a first half of a bottom pin connector by securing a bottom pin connector extending hydraulic wet connector to a lower tubular portion is depicted as step 100. The lower tubular portion can include a lower tubular body, a first pin, and a lower hydraulic flow path.

An embodiment of the first half of a pin connector is depicted above in FIG. 5. The method further includes step 102 attaching the first half of the bottom pin connector to at least one first hydraulically operated tool. The first half of the top pin connector can be attached to the hydraulically operated tool using a port, a quick connect, a control line, or similar means of connecting to a hydraulically operated tool.

In step 104 the method is depicted including attaching a first packer with a bore to the first half of the bottom pin connector. The packer can be attached to the first half of the bottom pin connector by using fasteners or other removable securing means.

The first half of the bottom pin connector with the attached first packer is run into the well downhole in step 106.

The present embodiment of the method includes forming a second half of a bottom pin connector in step 108. The second half of the bottom pin connector is formed by securing a bottom pin connector receiving hydraulic wet connector to an upper tubular portion with a seal assembly. The upper tubular portion with seal assembly is depicted in FIG. 1 and FIG. 2.

The second half of the bottom pin connector is secured to production tubing in step 110. The production tubing can have a length ranging from 30 feet to 20,000 feet. A first control line having an inside diameter ranging from 0.125 to 0.475 inches is secured to the second half of the bottom pin connector in step 112.

In step 114 the production tubing the second half of the bottom pin connector, and the connected first control line is run into the well downhole. The bottom pin connector receiving hydraulic wet connector is connected to the bottom pin connector extending hydraulic wet connector in step 116. The bottom pin connector receiving wet connector and the top pin connector extending hydraulic wet connector can be quick release wet connectors.

The present embodiment of the method includes step 117, aligning the bottom pin connector hydraulic extending wet connector and the bottom pin connector receiving hydraulic wet connector. The alignment can be accomplished using at least one alignment key and one alignment groove.

The second half of the bottom pin connector is anchored to another piece of well equipment in step 118. The anchoring can be performed using a locking mechanism. The locking mechanism can be similar to the one depicted in FIG. 3.

In step 120 a first half of a top pin connector is formed by securing a second extending hydraulic wet connector to a top pin connector lower tubular portion. The top pin connector lower tubular portion is similar to the lower tubular portion of the bottom pin connector.

The first half of the top pin connector is attached to at least one second hydraulically operated tool, the second half of the bottom pin connector, or combinations thereof in step 122. In step 124 a second packer with a bore is attached to the first half of the top pin connector.

In step 126 the first half of the top pin connector with the attached second packer is ran into the well downhole.

In step 128 a second half of a top pin connector is formed by securing a top pin connector extending hydraulic wet connector to a top pin connector upper tubular portion. The top pin connector upper tubular portion is similar to the bottom pin connector upper tubular portion.

The first control line fluidly communicates with the first half of the top pin connector, the first hydraulically operated tool, and the second hydraulically operated tool.

A second control line is connected to the second half of the top pin connector to for connecting to a hydraulic source in step 130. The hydraulic source can be a hydraulic tank located on a surface, remote from the well. The second control line is in fluid communication with the bottom pin connector, the first hydraulically operated tool, and the second hydraulically operated tool, and the power source.

A second production tubing is secured to the second half of the top pin connector in step 132. The second production tubing can be similar to the first production tubing. In Step 134 the production tubing with the connected second half of the top pin connector and the connected second control line is ran into the well.

The top pin connector receiving hydraulic wet connector can be connected to the top pin connector extending hydraulic wet connector in step 136. The present embodiment of the method includes step 138 aligning the top pin connector hydraulic extending wet connector and the top pin connector receiving hydraulic wet connector. The alignment can be accomplished using at least one alignment key and one alignment groove.

In step 139 the second half of the top pin connector is anchored to another piece of well equipment.

Each of the upper hydraulic flow paths and intermediate hydraulic flow paths can be sealed using a plurality of upper hydraulic flow path seals between each tubular seal assembly body and each upper tubular body.

A means for retaining the upper hydraulic flow path seals can be provided. The retaining can be accomplished by using a plurality of seal assembly fasteners.

The method can further include supporting at least one of the hydraulic flow path seals using at least one seal ring.

The present embodiment of the method can include preventing hydraulic fluid from escaping each of the hydraulic flow paths using at least one hydraulic flow path plug for each pin connector with seal assembly.

In step 140 the above steps can be repeated to adapt the method for use with a multi-zone well having more than two zones.

The present embodiment of the invention includes step 142 which is controlling the well, using the control lines, on a periodic basis. The periodic basis is defined as activating the well for a time ranging form 2 minutes to 120 minutes. The batch basis is equivalent to the periodic basis.

The present embodiment of the method can be adapted for use with a gravel pack using a second pin surrounding the first pin in each lower tubular portion forming a double pin connecter.

Figure 7:
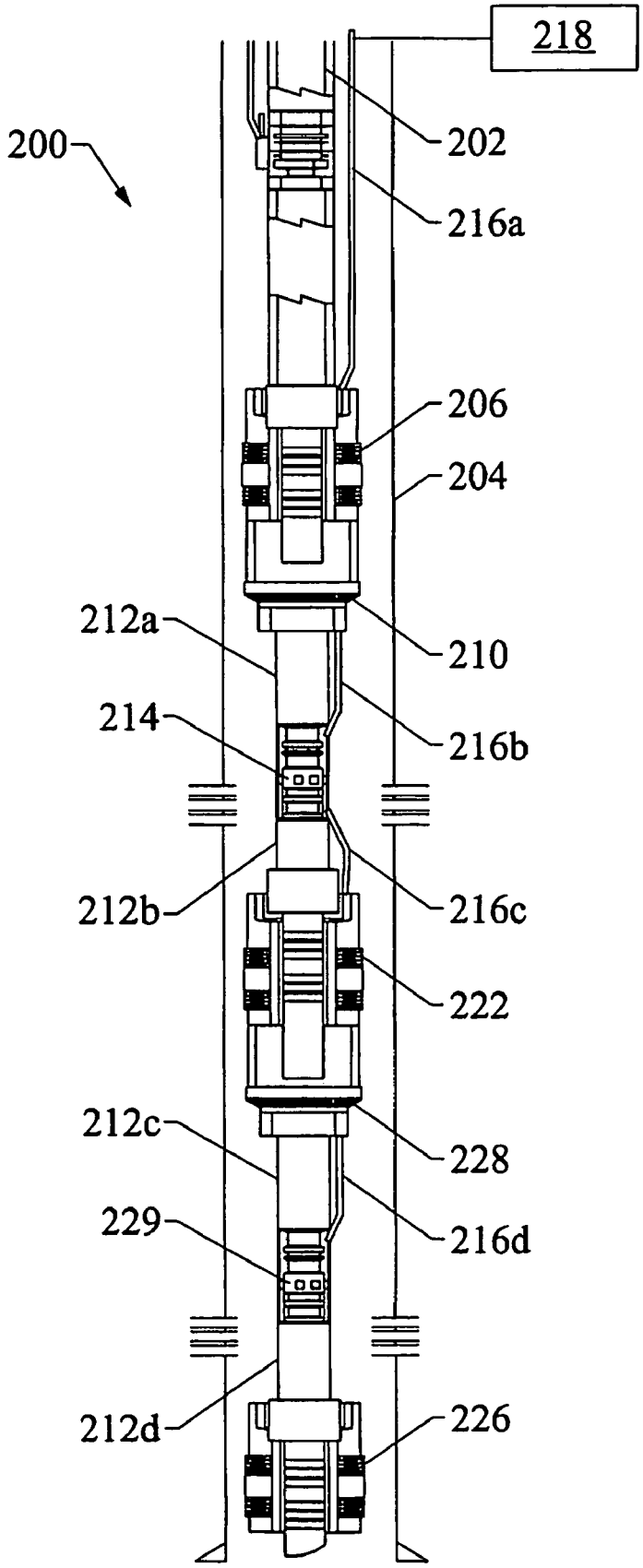
FIG. 7 depicts an embodiment of an assembled well completion system which can be created by an embodiment of the method.

FIG. 7 depicts an embodiment of the completion system for a well 200. The completion system for the well 200 can include an upper production tubing 202. The upper production tubing 202 can have an inner diameter ranging from 1.9 inches to 7 inches. The upper production tubing 202 can be disposed in a wellbore 204. A first packer 206 can engage the upper production tubing 202.

The first packer 206 can be engaged by a top pin connector with seal assembly 210. An example of the top pin connector with seal assembly 210 can be seen in FIGS. 1-5.

The top pin connector can engage an intermediate production tubing 212*a*. The intermediate production tubing 212*a* can be similar to the top production tubing.

A top hydraulically operated tool 214 is depicted engaging the intermediate production tubing 212*a*. The top hydraulically operated tool 214 can be a single line sleeve, a valve, or a similar downhole tool.

A top control line 216*a* is secured to a power source 218. The power source 218 can be a remote hydraulic tank, a pressurized tank, a fluid reservoir, or a similar fluid containment device. The upper tubular portion of the top pin connector with seal assembly 210 is in fluid communication with the top control line 216*a*.

The first intermediate production tubing 212*a* is secured to the lower tubular portion of the top pin connector with seal assembly 210 and the top hydraulically operated tool 214. A second control line 216*b* is connected to the lower tubular portion of the top pin connector with seal assembly 210 and the top hydraulically operated tool 214.

A second packer 222 is depicted engaging the second intermediate production tubing 212*b*.

A third control line 216*c* is in fluid communication from the top hydraulically operated tool 214 to a upper tubular portion of the bottom pin connector with seal assembly 228. A fourth control line 216*d* is in communication with the lower tubular portion of the bottom pin connector with seal assembly 228 and a bottom hydraulically operated tool 229. The second bottom control line 216*d* can be used to periodically operate the bottom hydraulically operated tool 229. A first bottom production tubing 212*c* is disposed between the bottom pin connector with seal assembly and the bottom hydraulically operated tool 229.

A second bottom production tubing 212*d* is depicted engaging the bottom hydraulically operated tool 229 and a lower sealing means 226. The lower sealing means 226 can be a packer, a plug, or similar sealing means.

While these embodiments have been described with emphasis on the embodiments, it should be understood that within the scope of the appended claims, the embodiments might be practiced other than as specifically described herein.

What is claimed is:

1. A method of connecting control lines to well bore equipment for controlling a well on a batch basis comprising:

forming a first half of a top pin connector by securing an extending hydraulic wet connector to a lower tubular portion, wherein the lower tubular portion comprises a lower tubular body, a first pin, and a lower hydraulic flow path;

attaching the first half of the pin connector to at least one hydraulically operated tool;

attaching a first packer with a bore to the first half of the pin connector;

running the first half of the pin connector with the attached first packer into the well;

forming a second half of a pin connector by securing a receiving hydraulic wet connector to an upper tubular portion with seal assembly, wherein the upper tubular portion comprises an upper tubular body and an intermediate hydraulic flow path; and wherein the seal assembly comprises: a tubular seal assembly body, an upper hydraulic flow path engaging the intermediate hydraulic flow path, a plurality of upper concentric seals for sealing the second half of the pin connector into the bore of the first packer, and at least one fastener;

connecting the second half of the pin connector to production tubing;

connecting a control line to the second half of the pin connector;

running the production tubing with the connected second half of the pin connector and the connected control line into the well;

connecting the receiving hydraulic wet connector to the extending hydraulic wet connector;

anchoring the second half of the pin connector to another piece of well equipment; and operating the well on a periodic basis using the control line.

2. The method of claim 1, wherein the at least one hydraulically operated tool is a hydraulic sleeve, an injection mandrel, a hydraulic valve, or combinations thereof.

3. The method of claim 1, wherein the upper tubular portion comprises an upper portion of the locking mechanism connected to the upper tubular body engaging a locking mechanism on the lower tubular body.

4. The method of claim 1, wherein the other piece of well equipment is a member of the group consisting of: the first half of the pin connector, another piece of well equipment, or combinations thereof.

5. The method of claim 1, further comprising the step of aligning the receiving hydraulic wet connector to the extending hydraulic wet connector using at least one alignment key with an alignment groove.

6. The method of claim 1, further comprising the step of sealing the upper hydraulic flow path and intermediate hydraulic flow path using a plurality of upper hydraulic flow path seals between the tubular seal assembly body and the upper tubular body.

7. The method of claim 6, further comprising supporting at least one of the upper hydraulic flow path seals using at least one seal ring.

8. The method of claim 1, further comprising the step of providing a means for retaining the upper hydraulic flow seals using a plurality of seal assembly fasteners.

9. The method of claim 1, further comprising the step of using a quick release receiving hydraulic wet connector.

10. The method of claim 1, wherein the anchoring the second half of the pin connector to another piece of well equipment is performed using a locking mechanism comprising:

a locking key;

a lower key retainer;

a shear pin for engaging the locking key and the lower key retainer;

an upper key retainer for engaging the locking key and the upper tubular portion;

at least one fastener; and a mechanism for exerting a force on the locking key and the upper tubular portion.

11. The method of claim 1, further comprising using a second pin surrounding the first pin in the lower tubular portion forming a double pin connector, and wherein the double pin connector is adapted for multi-zone gravel packing in a well.

12. The method of claim 1, further comprising using a control line connector disposed between the first pin outer surface and the lower tubular body face to connect to the at least one hydraulically operated tool.

13. The method of claim 1, further comprising the step of preventing hydraulic fluid from escaping one of the hydraulic flow paths using a hydraulic flow path plug for providing a sealing engagement with the upper hydraulic flow path and the tubular seal assembly body.

14. A multi-zone method of connecting control lines to well bore equipment for controlling a well on a batch basis comprising:

forming a first half of a bottom pin connector by securing an extending hydraulic wet connector to a lower tubular portion, wherein the lower tubular portion comprises a lower tubular body, a first pin, and a lower hydraulic flow path;

attaching a first packer with a bore to the first half of the bottom pin connector;

running the first half of the bottom pin connector with the attached first packer into the well downhole;

forming a second half of a bottom pin connector by securing a first receiving hydraulic wet connector to an upper tubular portion with seal assembly, wherein the upper tubular portion comprises an upper tubular body and an intermediate hydraulic flow path; and the seal assembly comprising: a tubular seal assembly body, an upper hydraulic flow path engaging the intermediate hydraulic flow path, a plurality of upper concentric seals for sealing the second half of the pin connector into the bore of the first packer, and at least one fastener;

connecting a first control line to the second half of the bottom pin connector for connecting the second half of the bottom pin connector to at least one second hydraulically operated tool;

connecting the second half of the bottom pin connector to a first production tubing;

running the second half of the bottom pin connector with the connected production tubing and second control line into the well;

forming a first half of a top pin connector by securing a top pin connector extending hydraulic wet connector to a lower tubular portion, wherein the lower tubular portion comprises a lower tubular body, a second pin, a lower hydraulic flow path;

attaching the first half of the top pin connector the at least one second hydraulically operated tool, the second half of the bottom pin connector, or combinations thereof;

attaching a second packer with a bore to the first half of the top pin connector;

running the first half of the top pin connector with the attached second packer into the well;

forming a second half of a top pin connector by securing a bottom pin connector receiving hydraulic wet connector to a bottom pin connector upper tubular portion with seal assembly, wherein the second pin upper tubular portion comprises an upper tubular body and an intermediate hydraulic flow path; and the seal assembly comprising: a tubular seal assembly body, an upper hydraulic flow path engaging the intermediate hydraulic flow path, a plurality of upper concentric seals for sealing the second half of the top pin connector into the bore of the second packer, and at least one fastener;

connecting a second control line to the second half of the top pin connector, for connecting to a hydraulic source, connecting a second production tubing to the second half of the top pin connector;

running the production tubing with the connected second half of the top pin connector and the connected second control line into the well;

connecting the receiving hydraulic wet connector of the top pin connector to the extending hydraulic wet connector of the top pin connector;

anchoring the second half of the top pin connector to another piece of well equipment; and operating the well on a periodic basis using the control lines.

15. The method of claim 14, wherein the second control line terminates at the second half of the second pin connector.

16. The method of claim 14, wherein the second control line fluidly communicates with the first control line.

17. The method of claim 14, wherein the at least one hydraulically operated tool is a hydraulic sleeve, an injection mandrel, a hydraulic valve, or combinations thereof.

18. The method of claim 14, wherein the upper tubular portion of each pin comprises an upper portion of a locking mechanism connected to each upper tubular body engaging a locking mechanism on each lower tubular body.

19. The method of claim 14, wherein the other piece of well equipment is a member of the group consisting of: the first half of the pin connector, another piece of well equipment, or combinations thereof.

20. The method of claim 14, further comprising aligning each receiving hydraulic wet connector to the extending hydraulic wet connector using at least one alignment key with an alignment groove.

21. The method of claim 14, further comprising the step of sealing each upper hydraulic flow path and intermediate hydraulic flow path using a plurality of upper hydraulic flow path seals between each tubular seal assembly body and each upper tubular body.

22. The method of claim 14, further comprising the step of providing a means for retaining the upper hydraulic flow seals using a plurality of seal assembly fasteners.

23. The method of claim 14, further comprising the step of using a quick release receiving hydraulic wet connector for each pin connector with seal assembly.

24. The method of claim 14, wherein steps 2 through 8 are repeated as necessary forming a multi-zone pin connector assembly.

25. The method of claim 14, wherein the anchoring the second half of the pin connector to another piece of well equipment is performed using a locking mechanism comprising:

a locking key;

a lower key retainer;

a shear pin for engaging the locking key and the lower key retainer;

an upper key retainer for engaging the locking key and the upper tubular portion;

at least one fastener; and a mechanism for exerting a force on the locking key and the upper tubular portion.

26. The method of claim 1, further comprising using a second pin surrounding the first pin in the lower tubular portion forming a double pin connector, and wherein the double pin connector is adapted for multi zone gravel packing in a well.

27. The method of claim 1, further comprising the step of preventing hydraulic fluid from escaping one of the hydraulic flow path using at least one hydraulic flow path plug for each pin connector with seal assembly.

28. The method of claim 27, further comprising supporting at least one of the upper hydraulic flow path seals using at least one seal ring.

* * * * *